US007967468B2

(12) United States Patent
Levine

(10) Patent No.: US 7,967,468 B2
(45) Date of Patent: Jun. 28, 2011

(54) ADJUSTABLE LIGHTING DEVICE

(76) Inventor: Jonathan E. Levine, New York, NY (US)

( * ) Notice: Subject to any disclaimer, the term of this patent is extended or adjusted under 35 U.S.C. 154(b) by 235 days.

(21) Appl. No.: 12/478,978

(22) Filed: Jun. 5, 2009

(65) Prior Publication Data

US 2009/0243495 A1 Oct. 1, 2009

Related U.S. Application Data

(63) Continuation of application No. 11/510,083, filed on Aug. 25, 2006, now Pat. No. 7,562,995.

(51) Int. Cl.
*F21V 17/10* (2006.01)

(52) U.S. Cl. ..... 362/197; 362/191; 362/372; 362/418; 362/427

(58) Field of Classification Search ..... 362/157, 362/191, 197, 199, 249.01–249.03, 249.07, 362/249.09, 249.1, 362, 372, 418, 427
See application file for complete search history.

(56) References Cited

U.S. PATENT DOCUMENTS

| | | | |
|---|---|---|---|
| D104,233 | S | 4/1937 | Arenberg |
| 2,345,234 | A | 3/1944 | Carter, Jr. |
| 2,595,520 | A | 5/1952 | Guerin |
| 2,790,894 | A | 4/1957 | Zingone |
| D222,500 | S | 10/1971 | Gugalot |
| D240,320 | S | 6/1976 | Anderson |
| D264,254 | S | 5/1982 | Heritage |
| D275,062 | S | 8/1984 | Sorko-Ram et al. |
| 4,494,177 | A | 1/1985 | Matthews |
| 4,515,570 | A | 5/1985 | Beltran |
| D293,940 | S | 1/1988 | Lasker |
| 4,751,627 | A | 6/1988 | Usher |
| D299,549 | S | 1/1989 | Macaluso |
| 4,816,969 | A | 3/1989 | Miller |
| D312,136 | S | 11/1990 | Miletich et al. |
| 5,012,394 | A | 4/1991 | Woodward |
| D320,863 | S | 10/1991 | Macaluso |
| 5,169,226 | A | 12/1992 | Friedman |
| 5,265,000 | A | 11/1993 | Lin |
| D346,459 | S | 4/1994 | King |
| D371,857 | S | 7/1996 | Gismondi |
| 5,595,436 | A | 1/1997 | Way, Jr. et al. |
| 5,765,939 | A | 6/1998 | Tanner, Jr. |
| 5,769,529 | A | 6/1998 | Weinstock et al. |
| 5,795,050 | A | 8/1998 | Carter |
| 5,871,274 | A | 2/1999 | Lee et al. |
| 5,911,499 | A | 6/1999 | Stafford et al. |
| D412,040 | S | 7/1999 | Hudak et al. |
| 5,934,787 | A | 8/1999 | Sharma |

(Continued)

OTHER PUBLICATIONS

First Office Action Dated May 19, 2008 for U.S. Appl. No. 11/510,083 (11 pages).

(Continued)

*Primary Examiner* — Stephen F Husar
*Assistant Examiner* — Meghan K Dunwiddie
(74) *Attorney, Agent, or Firm* — Theodore W. Baker

(57) ABSTRACT

A lighting device is disclosed. The lighting device can be battery-powered and can include one or more LEDs within a light assembly. The device also can include a battery compartment, a first frame element, and a second frame element. The light assembly can be supported by the first frame element and free to tilt on a first axis relative to the first frame element. The light assembly can be free to rotate relative to the second frame element on a second axis substantially perpendicular to the first axis. The second frame element can be, for example, a plate configured to be fixedly mounted to a surface, such as a wall.

22 Claims, 4 Drawing Sheets

U.S. PATENT DOCUMENTS

| | | | |
|---|---|---|---|
| 6,146,001 | A | 11/2000 | Cwiakala |
| 6,206,541 | B1 | 3/2001 | Landamia |
| D440,673 | S | 4/2001 | Handsaker |
| D443,713 | S | 6/2001 | Benensohn |
| D446,321 | S | 8/2001 | Lin |
| 6,280,042 | B1 | 8/2001 | Wegrzyn et al. |
| 6,390,652 | B1 | 5/2002 | Echito |
| 6,406,161 | B1 | 6/2002 | Lin et al. |
| 6,536,924 | B2 | 3/2003 | Segretto |
| 6,566,824 | B2 | 5/2003 | Panagotacos et al. |
| 6,588,920 | B2 | 7/2003 | Agro |
| 6,619,813 | B1 | 9/2003 | Schnell |
| 6,641,283 | B1 | 11/2003 | Bohler |
| D484,270 | S | 12/2003 | Yiu |
| D485,390 | S | 1/2004 | Stancik et al. |
| 6,726,502 | B1 | 4/2004 | Hayes |
| D490,925 | S | 6/2004 | Wilmotte |
| 6,827,465 | B2 | 12/2004 | Shemitz et al. |
| 6,877,875 | B2 | 4/2005 | Yu et al. |
| D506,560 | S | 6/2005 | Oas |
| 6,905,231 | B2 | 6/2005 | Dickie |
| D507,373 | S | 7/2005 | Kim |
| D509,016 | S | 8/2005 | Benghozi |
| D509,617 | S | 9/2005 | Benghozi |
| 6,955,442 | B1 | 10/2005 | Chan |
| 6,979,107 | B1 | 12/2005 | Benensohn |
| 7,066,619 | B2 | 6/2006 | Waters |
| D535,262 | S | 1/2007 | Saito et al. |
| D535,740 | S | 1/2007 | Brown et al. |
| D544,117 | S | 6/2007 | Coushaine |
| D544,618 | S | 6/2007 | Coushaine |
| D544,988 | S | 6/2007 | Benensohn |
| D551,795 | S | 9/2007 | Compton et al. |
| 7,270,443 | B2 | 9/2007 | Kurtz et al. |
| 7,303,327 | B2 | 12/2007 | Copeland et al. |
| D561,925 | S | 2/2008 | Levine |
| D563,013 | S | 2/2008 | Levine |
| D563,014 | S | 2/2008 | Levine |
| D563,582 | S | 3/2008 | Levine |
| D565,232 | S | 3/2008 | Butler |
| D567,987 | S | 4/2008 | Khubani |
| D576,334 | S | 9/2008 | Levine |
| D576,338 | S | 9/2008 | Levine |
| D578,246 | S | 10/2008 | Levine |
| D578,703 | S | 10/2008 | Levine |
| D581,572 | S | 11/2008 | Levine |
| D582,601 | S | 12/2008 | Levine |
| D585,152 | S | 1/2009 | Levine |
| D586,491 | S | 2/2009 | Levine |
| 7,562,995 | B1 | 7/2009 | Levine |
| 7,618,150 | B2 | 11/2009 | Chien |
| 2001/0009511 | A1 | 7/2001 | Griffiths |
| 2002/0145876 | A1 | 10/2002 | Juang |
| 2003/0179572 | A1 | 9/2003 | Schnell |
| 2004/0240090 | A1 | 12/2004 | Skiver et al. |
| 2005/0094395 | A1 | 5/2005 | Rosenberg |
| 2006/0050519 | A1 | 3/2006 | Lin |
| 2006/0092637 | A1 | 5/2006 | Yeh |
| 2006/0250789 | A1 | 11/2006 | Coushaine |
| 2006/0256584 | A1 | 11/2006 | Paoluccio |
| 2007/0070645 | A1 | 3/2007 | Coushaine et al. |
| 2008/0137326 | A1 | 6/2008 | Levine |
| 2009/0154151 | A1 | 6/2009 | Levine |
| 2010/0182781 | A1 | 7/2010 | Levine |

OTHER PUBLICATIONS

Final Office Action Dated Nov. 13, 2008 for U.S. Appl. No. 11/510,083 (19 pages).

ADJUSTABLE LIGHTING DEVICE

CROSS REFERENCE TO RELATED APPLICATION

This is a continuation application based on prior U.S. patent application Ser. No. 11/510,083, filed Aug. 25, 2006, now issued as U.S. Pat. No. 7,562,995. The prior application is incorporated herein by this reference.

FIELD

This disclosure concerns lighting devices, such as puck lights and other compact lighting devices adapted for convenient mounting and operation, particularly with regard to mechanisms in such devices for controlling the direction of emitted light.

BACKGROUND

Puck lights (so named because they often resemble hockey pucks in shape) have become increasingly popular as consumer products. These devices can be used, for example, to conveniently add a light source to small areas that are insufficiently lit by overhead lighting. In one example of a common application, a puck light is mounted to the underside of kitchen cabinet to provide lighting for a countertop. Puck lights and other compact lighting devices also can be used to provide accent lighting and to provide light in areas that may have no other light source, such as storage units and automobiles.

One example of a known puck light is disclosed in U.S. Pat. No. 6,641,283 (Bohler). Bohler describes a puck light including light emitting diodes (LEDs) and an optical assembly that "focuses and disperses the LED output to a desired light contour" (abstract). The puck light of Bohler can be powered by a battery system (column 3, lines 9-12). As another example, U.S. Pat. No. 6,979,107 (Benensohn) discloses a hard-wired puck light including a "reflector [that] defines a dished cavity" and a "light transmissive cover" positioned over the reflector (abstract and FIG. 1).

SUMMARY

Disclosed herein are embodiments of a lighting device, such as battery-powered lighting device. Some embodiments include a light assembly, a battery compartment, a first frame element, and a second frame element. The light assembly can be supported by the first frame element and free to tilt on a first axis relative to the first frame element. For example, the light assembly can include a projection at least partially received by a recess in the first frame element. In such embodiments, the light assembly can be free to tilt on the projection. Moreover, the projection can include a notch and the first frame element can include a nub that slides into the notch when the lighting element is tilted.

The overall lighting device can be shaped as an oblate spheroid. Some embodiments have a height-to-width ratio from about 0.2 to about 1. In addition to tilting, the light assembly can be free to rotate relative to the second frame element on a second axis substantially perpendicular to the first axis. In some embodiments, the light assembly can be separated from the second frame element to expose the battery compartment, which can be fixedly attached to the light assembly. The second frame element can comprises a plate configured to be mounted to a surface, such as a wall. Embodiments of the lighting device also can include a motion sensor and/or a light sensor, which can be configured to activate a lighting element in the lighting device upon sensing light from another source.

In some embodiments the light assembly includes one or more LED. For example, in some embodiments the light assembly includes a plurality of LEDs positioned on a substantially flat surface. The light assembly also can include a light-transmissive face plate. In such embodiments, a reflective plate can be positioned under the face plate and a lighting element positioned between the reflective plate and the face plate. The face plate can include a substantially flat and light-transmissive power button.

DETAILED DESCRIPTION

Throughout this disclosure, the singular terms "a," "an," and "the" include plural referents unless the context clearly indicates otherwise. Similarly, the word "or" is intended to include "and" unless the context clearly indicates otherwise.

Described herein are embodiments of a lighting device and embodiments of a method for making the lighting device. Conventional compact lighting devices typically are fixed so that the direction of emitted light cannot be adjusted. In contrast, embodiments of the disclosed lighting device can include features that allow adjustment of the direction of emitted light. This is useful for a variety of applications. For example, the angle of emitted light can be adjusted to focus light on a work area without moving the entire device. Moreover, if the device is mounted, the angle of emitted light can be adjusted without the need to remove and remount the device. The ability to ad just the angle of emitted light also may facilitate targeted accent lighting.

Figure 1:
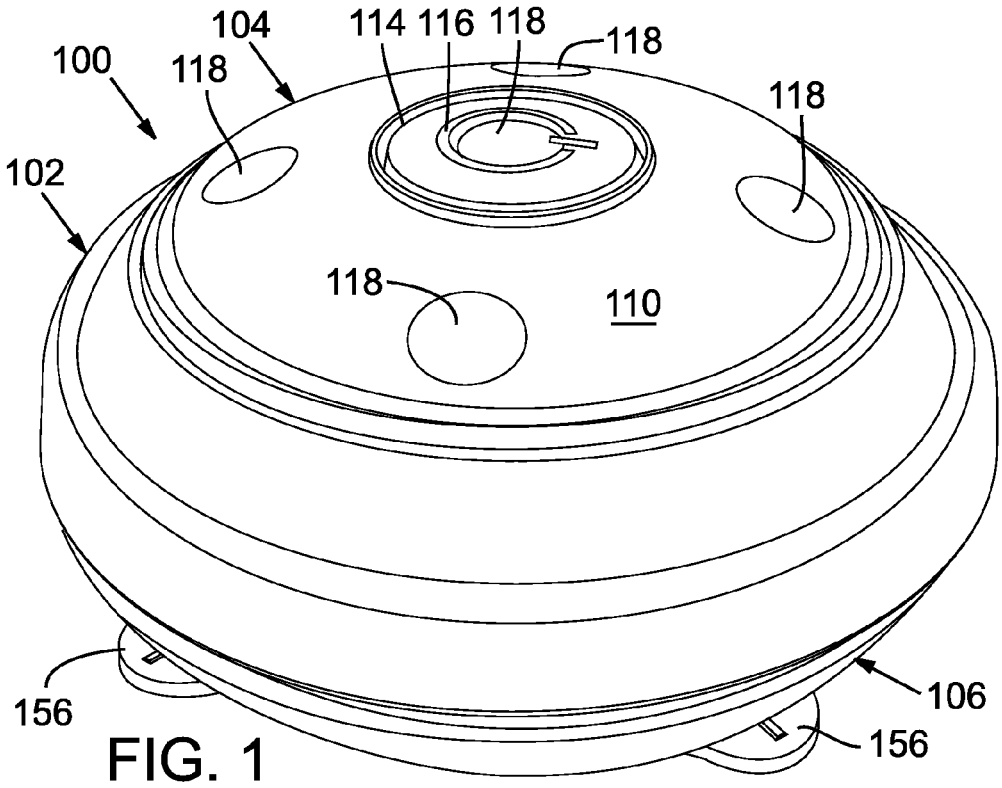
FIG. 1 is a perspective view of one embodiment of the disclosed lighting device.

FIGS. 1-6 illustrate an embodiment of the disclosed device. As shown in FIG. 1, the device 100 is shaped substantially as an oblate spheroid. In other embodiments, the device 100 may substantially resemble some other shape, such as a prolate spheroid, a sphere, a hemisphere, a cylinder, or a cone. Typically, embodiments of the device 100 are at least partially rounded in shape. Other embodiments, however, may have only sharp corners and substantially resemble polyhedrons. The device 100 can be any size, but typically is compact. For example, the device 100 can have a width (substantially perpendicular to the primary direction of emitted light) from about 1 centimeter to about 20 centimeters, such as from about 2 centimeters to about 15 centimeters or from about 4 centimeters to about 8 centimeters. Embodiments of the device 100 may have a height (substantially parallel to the primary direction of emitted light), for example, from about 0.5 centimeter to about 10 centimeters, such as from about 1 centimeter to about 8 centimeters or from about 3 centimeters to about 6 centimeters. The height-to-width ratio of the device can be, for example, from about 0.1 to about 2, such as from about 0.2 to about 1 or from about 0.3 to about 0.6.

Figure 6:
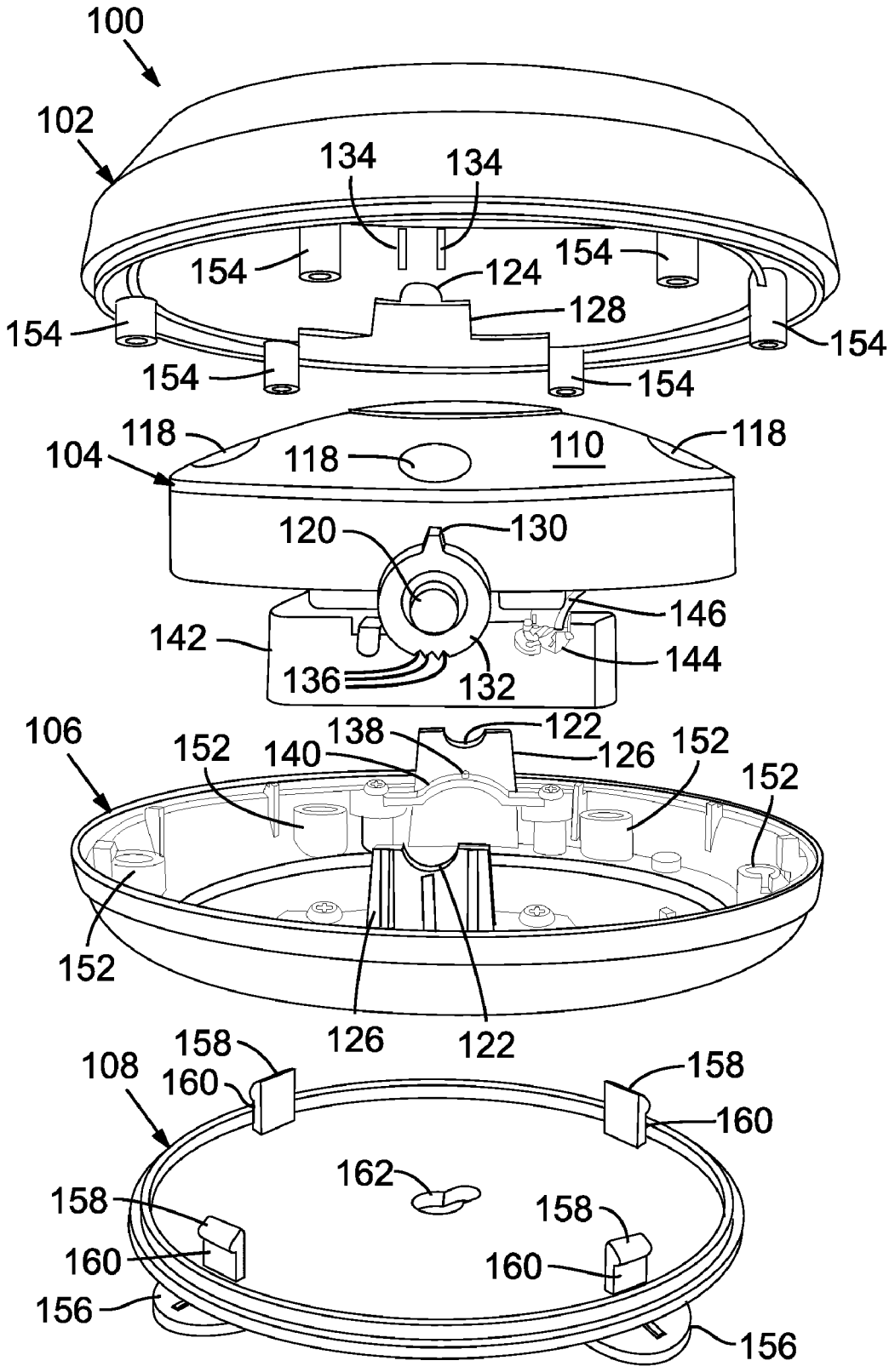
FIG. 6 is an exploded perspective view of the lighting device embodiment shown in FIG. 1.

As best seen in FIG. 6, the illustrated embodiment includes four major sections: a top shell 102, a light assembly 104, a bottom shell 106 and a battery-access plate 108. When assembled, a portion of the light assembly 104 preferably protrudes through an opening in the top shell 102. The protruding portion of the light assembly 104 includes a face plate 110 that allows the transmission of light from lighting elements 112 (see FIG. 3) within the light assembly 104. To promote the transmission of light, the lighting elements 112 are mounted on a reflective plate (not shown) below the face plate 110. The illustrated embodiment includes five lighting elements 112, but other embodiments may include a different number of lighting elements, such as one, two, three, four, six, seven, eight, nine, ten or a greater number of lighting elements.

The face plate 110 can be made of plastic, glass or another substantially optically-transmissive material. In the illustrated embodiment, the face plate 110 includes a power button 114 at its center. The majority of the inside surface of the face plate 110 preferably is coated to give it a slightly frosted appearance. A portion of the inner surface of the power button 114 is frosted with a darker material to form a power symbol 116. The face plate 110 also includes five uncoated windows 118 above the individual lighting elements 112. One of the windows 118 is positioned within the power symbol 116. The remaining four windows 118 are distributed radially around the power button 114.

In the illustrated embodiment, the lighting elements 112 are white LEDs. In other embodiments the lighting elements 112 can be incandescent, fluorescent, halogen, xenon, neon, or some other commercially-available lighting type. LEDs are particularly well suited for use in disclosed embodiments due to their compact size, low power demand, low heat output, long life and high durability. Instead of white LEDs, other embodiments may include LEDs of another color, such as red, orange, yellow, green or blue.

Figure 2:
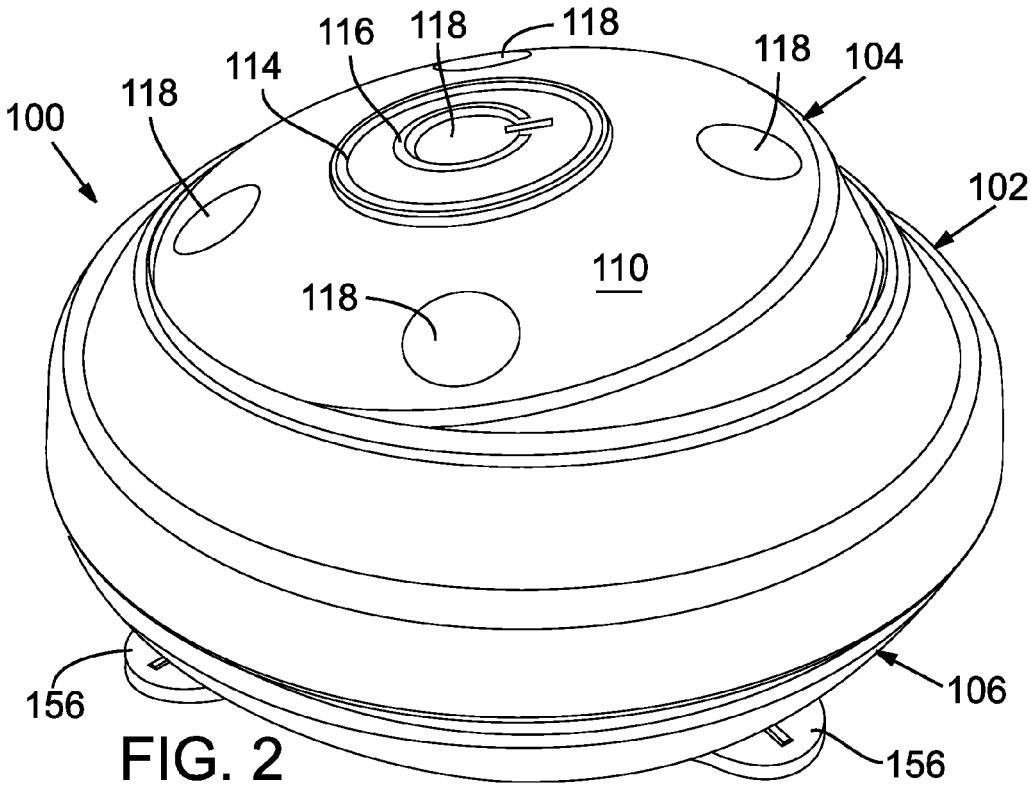
FIG. 2 is a perspective view of the lighting device embodiment shown in FIG. 1 with a light assembly thereof tilted in one direction.
Figure 3:
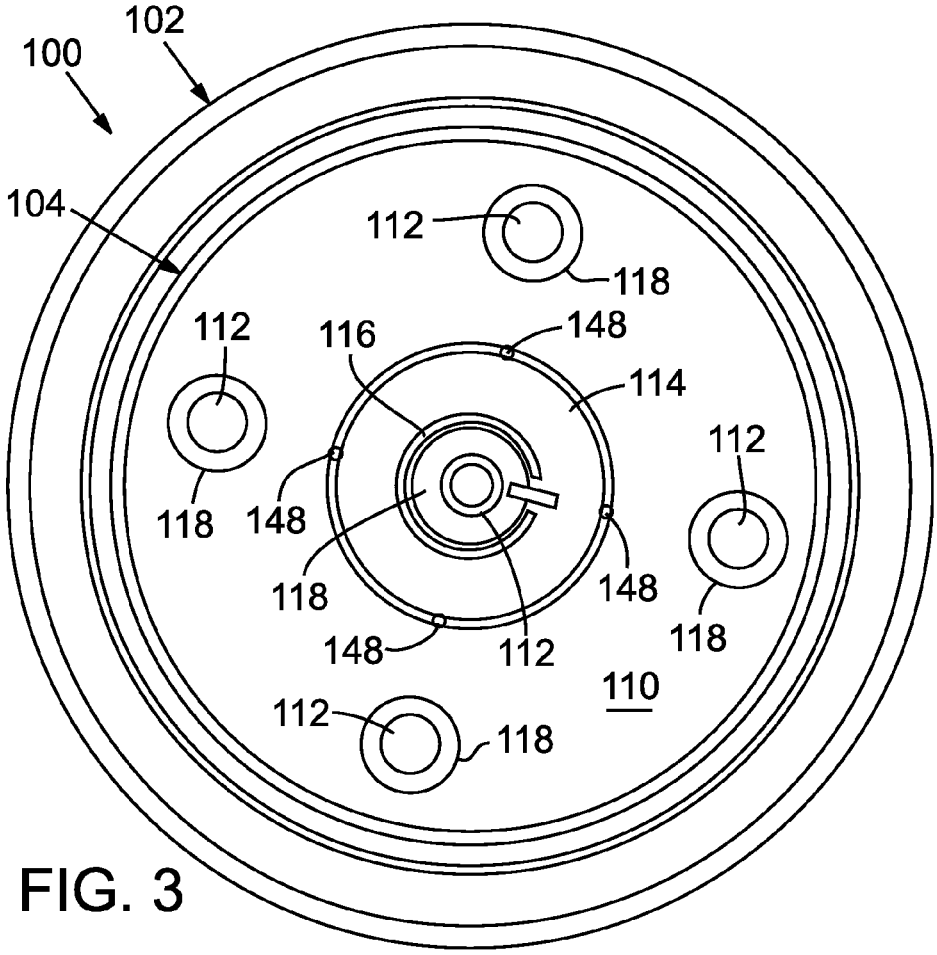
FIG. 3 is a plan view of the top of the lighting device embodiment shown in FIG. 1.
Figure 4:
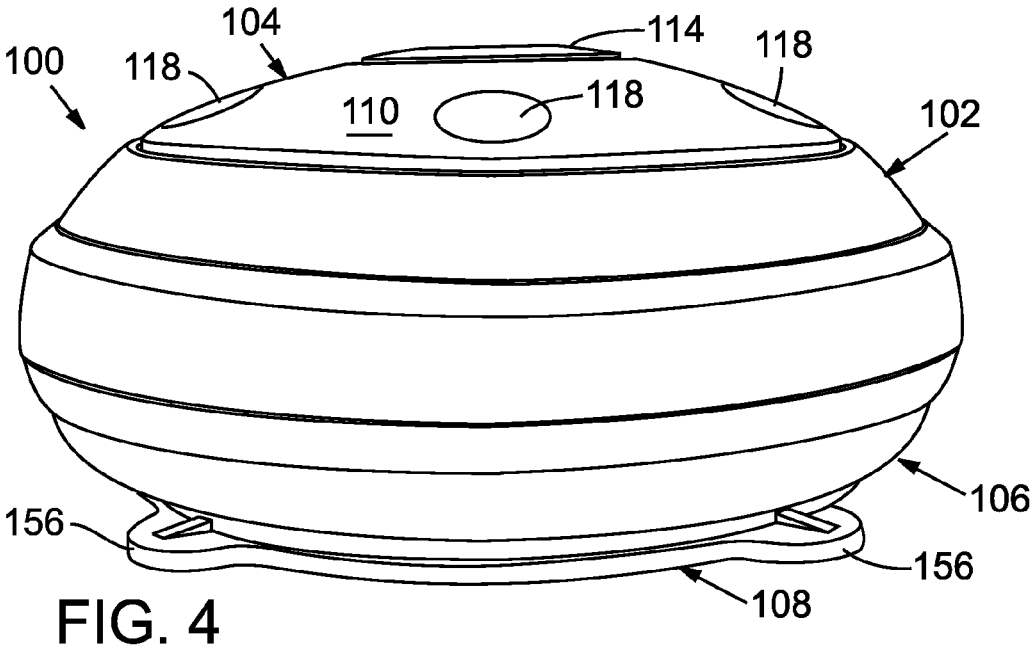
FIG. 4 is a profile view of the lighting device embodiment shown in FIG. 1.
Figure 5:
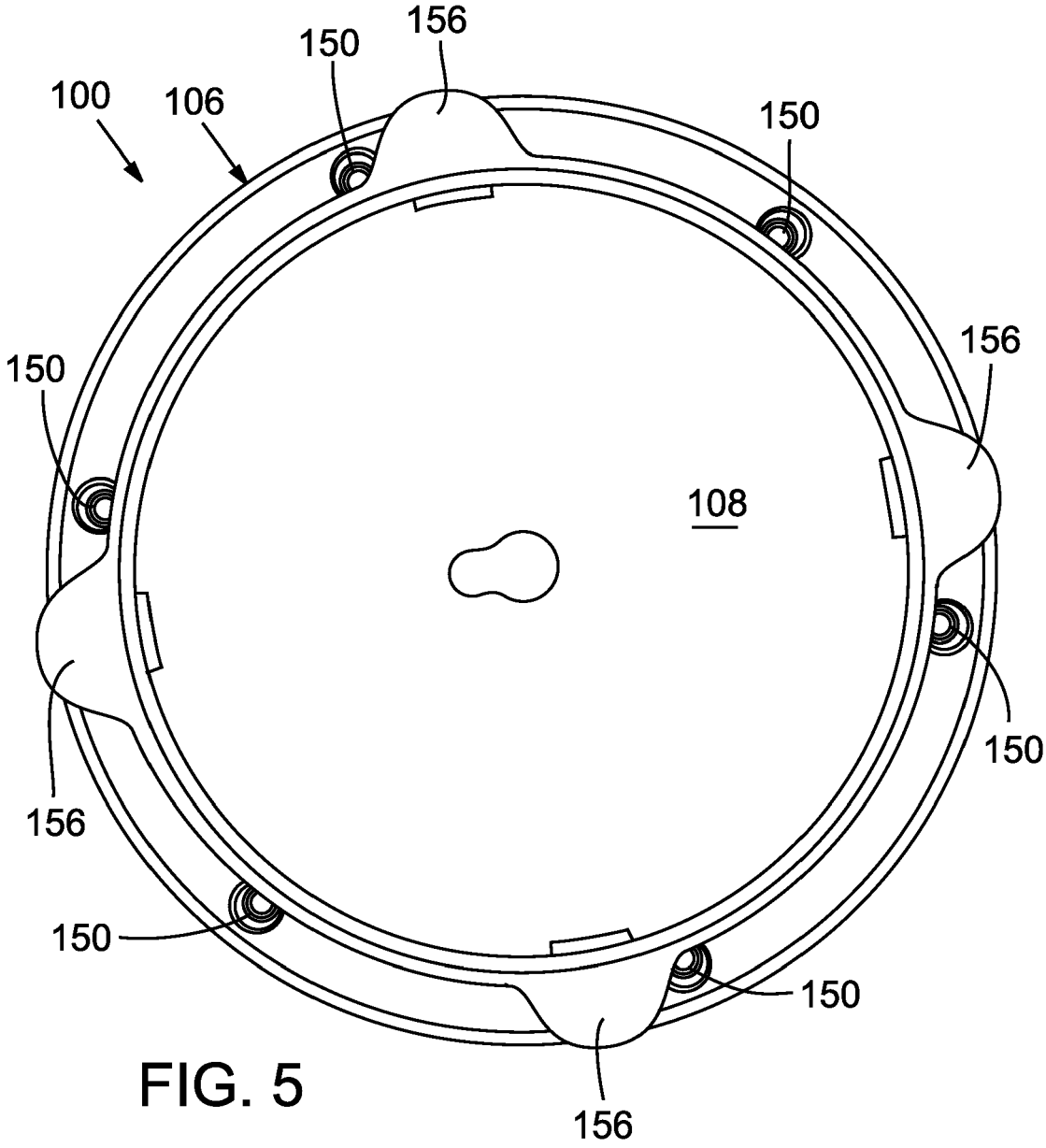
FIG. 5 is a plan view of the bottom of the lighting device embodiment shown in FIG. 1.

FIG. 2 shows the device 100 with the light assembly 104 tilted to one side. The light assembly 104 also can be tilted to the opposite side. This tilting is made possible by certain internal components shown in FIG. 6. The light assembly 104 includes two rounded projections 120 (one shown) on which it can be rotated. Each rounded projection 120 is positioned loosely between a bottom recess 122 in the bottom shell 106 and a top recess 124 (one shown) in the top shell 102. The bottom recesses 122 preferably are formed in supports 126 that project upward into channels 128 (one shown) within the top shell 102. In other embodiments, the light assembly 104 may have no tilting functionality or may tilt by some other mechanism. For example, the light assembly 104 may tilt on an axle.

Referring again to FIG. 6, the range of tilting motion of the light assembly 104 is controlled by teeth 130 projecting from the tops of rings 132 positioned coaxially around the projections 120. As the light assembly 104 tilts on the projections 120, each tooth 130 moves radially between two stops 134 (one of two pairs shown). The stops 134 extend from the inner surface of the top shell 102 and, as with many of the components described herein, may be cast or otherwise formed as an integrated part of the top shell. When the teeth 130 press against the stops 134, further tilting of the light assembly 104 is restricted. In other embodiments, tilting of the light assembly 104 may be unrestricted or may be restricted by another mechanism. For example, stops can be positioned on either side of the bottom shell 106 such that they press against a bottom surface of the light assembly 104 when it tilts to a certain degree.

In the illustrated embodiment, three notches 136 (one of two sets shown) at the bottom of each ring 132 interact with nubs 138 (one shown) on support plates 140 (one shown) adjacent to each support 126 to produce a clicking sound when the light assembly 104 is tilted. Interaction between the notches 136 and the nubs 138 also holds the light assembly 104 in one of three defined positions (i.e., straight, tilted one direction, or tilted the other direction). Each of the three notches 136 corresponds to one position. Other embodiments may include a different number of notches 136, such as one, two, four, five, or a greater number of notches. Alternatively, the light assembly 104 may be held in place by some other mechanism, such as friction.

As shown in FIG. 6, the device 100 also includes a battery compartment 142 attached to the light assembly 104. A conventional circuit board (not shown) is positioned between the battery compartment 142 and the light assembly 104. In the illustrated embodiment, the battery compartment 142 is configured to hold three AAA batteries positioned side-by-side. These batteries are electrically connected in series with soldered connections 144 at the beginning and end of the series. Wires 146 extending from the soldered connections 144 provide power to the circuit board. Other embodiments may include different power supply configurations. Embodiments powered by batteries can include any number, type and arrangement of batteries, such as two AA batteries in parallel or one nine volt battery directly connected to the circuit. Other embodiments may be hard wired to a permanent power source, such as a wall circuit.

The power button 114 (FIGS. 1-4) includes a disk-like portion of the face plate 110 and a cylindrical portion (not shown) that extends downward from the perimeter of the disk-like portion to the reflective plate. The cylindrical portion is made of the same substantially light-transmissive material as the face plate 110. Four pins 148 (see FIG. 3) attached to the bottom edge of the cylindrical portion project through the reflective plate to the circuit board. Instead of a power button 114, other embodiments may include another type of switch, such as a toggle switch or a rocker switch. Such switches can be positioned, for example, on a portion of the device 100 other than the face plate 110.

When the power button 114 is depressed, one or more of the pins 148 touches a switch on the circuit board that turns the lighting elements 112 on or off. The power button 114 also can be configured to toggle the lighting elements 112 between levels of light intensity. For example, a single press of the power button 114 may turn the lighting elements 112 on, a second press of the power button may increase the light intensity and a third press of the power button may turn the lighting elements off. Alternatively, the power button 114 can be configured to toggle between the activation of different numbers of lighting elements 112 from among a plurality of lighting elements. For example, a single press of the power button 114 may turn on a limited number of lighting elements 112, a second press of the power button may increase the number of illuminated lighting elements, and a third press of the power button may turn all the lighting elements off. The functionality of toggling the light intensity or the number of illuminated lighting elements can be incorporated by including a commercially-available dimmer or toggle switch on the circuit board.

The top shell 102, the light assembly 104 and the bottom shell 106 are secured using screws 150 (FIG. 5) that extend through openings 152 (FIG. 6) in the bottom shell 106 and into screw-receiving elements 154 (FIG. 6) in the top shell 102. The screws 150 releasably secure the bottom shell 106 to the top shell 102 with the light assembly 104 pivotally supported therebetween. The bottom shell 106 includes an opening that allows access to the battery compartment 142. When the device 100 is assembled, the opening in the bottom shell 106 is covered by the battery-access plate 108. Tabs 156 are positioned around the perimeter of the battery-access plate 108 to facilitate its removal from the opening in the bottom shell 106. For example, when the batteries require replacement, a user can apply pressure to the tabs 156 to snap the battery access plate 108 out of the opening in the bottom shell 106.

As shown in FIG. 6, the battery-access plate 108 includes four guide clips 158 that extend vertically into the opening in the bottom shell 106. Each guide clip 158 defines a groove 160 to engage, preferably in a loose, snap-fit manner, a rim of the opening in the bottom shell 106. The battery-access plate 108 also includes a mounting hole 162 that is configured to receive a portion of a wall fastener, such as a screw having an enlarged head. Using the mounting hole 162, the battery-access plate 108 can be permanently or removably installed on a cabinet, wall or other household surface. The remainder of the device 100 then can be releasably clipped to the battery-access plate 108 via the guide clips 158. Other embodiments may include a mounting mechanism other than the mounting hole 162, such as magnetic material, hook and loop material or tape attached to the battery-access plate 108. The mounting material (e.g., magnetic material, hook and loop material or tape) can be placed within a recessed portion of the back surface of the battery-access plate 108. This allows the device 100 to be mounted substantially flush with a mounting surface.

When the device 100 is installed with the battery-access plate 108 fixed, the remainder of the device is free to rotate along the grooves 160. Specifically, the grooves 160 interact with the rim of the opening in the bottom shell 106 to guide, but not restrict, rotational movement of the bottom shell along with the other components attached to the bottom shell. In combination with the tilting functionality described above, rotation can be used to direct the emitted light as needed for a particular application. For example, a user can tilt the light assembly 104 and then rotate the top shell 102, light assembly 104 and bottom shell 106 relative to the battery-access plate 108 to direct the emitted light toward a particular location. It will be appreciated that the light assembly can be tilted and directed at any angle from 0° to 360° relative to the axis of rotation. In alternate embodiments, different portions of the device 100 may tilt and/or rotate. For example, in some embodiments, the light assembly may tilt and rotate (e.g., as a ball joint) relative to the remainder of the device 100.

Embodiments of the disclosed lighting device may include a variety of features in addition to or in place of those shown in FIGS. 1-6. For example, some embodiments include a sensor that activates and deactivates the lighting elements. In some embodiments, this sensor is a light sensor, such as a commercially available light sensor, that activates the lighting elements when light from another source is detected. This can be useful for applications in which the disclosed lighting device is not the primary lighting device for an area. Once the primary lighting device for an area (e.g., an overhead light) is activated, embodiments of the disclosed lighting device can be configured to activate automatically. In this way, secondary lighting, such as accent lighting, can be activated without the need for manual intervention. By the same principle, the lighting device can be activated by a motion sensor, such as a commercially available motion sensor. Embodiments including a sensor also can include a manual override switch to deactivate the sensor when automatic operation is not desirable. The manual override switch can be, for example, a commercially available switch that switches the flow of electrical current between a circuit including the sensor and a circuit not including the sensor.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A compact lighting device, comprising:

a light assembly including a light-emitting diode and two laterally extending projections;

a support frame including recesses corresponding to the laterally extending projections; and a mounting element for mounting the light assembly and support frame to a support surface, wherein interaction between the laterally extending projections and the recesses allows the light assembly to tilt on a first axis relative to the mounting element, the light assembly is free to rotate on a second axis relative to the mounting element, the first axis is substantially perpendicular to the second axis, tilting the light assembly on the first axis is substantially independent of rotating the light assembly on the second axis, the support frame substantially encloses a bottom portion of the light assembly, and the mounting element can be separated from the support frame to expose a battery compartment.

2. The compact lighting device according to claim 1, wherein at least one of the two laterally extending projections includes two or more notches, and the support frame includes a nub that slides into the notches when the lighting assembly is tilted on the first axis.

3. The compact lighting device according to claim 1, wherein the light assembly includes a substantially flat surface and a plurality of light-emitting diodes positioned on the substantially flat surface.

4. The compact lighting device according to claim 1, wherein the compact lighting device is substantially shaped as an oblate spheroid.

5. The compact lighting device according to claim 1, wherein the compact lighting device has a height-to-width ratio from about 0.2 to about 1.

6. The compact lighting device according to claim 1, further comprising a light sensor, a motion sensor, or both cooperable with the light assembly to activate the light assembly.

7. The compact lighting device according to claim 1, further comprising a light sensor configured to activate the light assembly upon sensing light from another source.

8. The compact lighting device according to claim 1, wherein tilting the light assembly on the first axis increases or decreases the depth to which a portion of the light assembly is inset within the support frame.

9. The compact lighting device according to claim 1, wherein the second axis is substantially perpendicular to a mounting surface of the mounting element.

10. The compact lighting device according to claim 1, wherein the light assembly includes a substantially light-transmissive power button.

11. A compact lighting device, comprising:

a light assembly including a light-emitting diode and a substantially light-transmissive power button;

a support frame for supporting the light assembly; and a mounting element for mounting the light assembly and support frame to a support surface, wherein the light assembly is free to tilt on a first axis relative to the mounting element, the light assembly is free to rotate on a second axis relative to the mounting element, the first axis is substantially perpendicular to the second axis, the first and second axes both pass through the support frame, tilting the light assembly on the first axis is substantially independent of rotating the light assembly on the second axis, and the mounting element can be separated from the support frame to expose a battery compartment.

12. The compact lighting device according to claim 11, wherein the compact lighting device is substantially shaped as an oblate spheroid.

13. The compact lighting device according to claim 11, wherein the compact lighting device has a height-to-width ratio from about 0.2 to about 1.

14. The compact lighting device according to claim 11, further comprising a light sensor, a motion sensor, or both cooperable with the light assembly to activate the light assembly.

15. The compact lighting device according to claim 11, further comprising a light sensor configured to activate the light assembly upon sensing light from another source.

16. The compact lighting device according to claim 11, wherein tilting the light assembly on the first axis increases or decreases the depth to which a portion of the light assembly is inset within the support frame.

17. The compact lighting device according to claim 11, wherein the second axis is substantially perpendicular to a mounting surface of the mounting element.

18. The compact lighting device according to claim 1, including a seam between the support frame and a substantially continuous perimeter of the light assembly, wherein the light assembly can be positioned along the first axis such that external surfaces of the light assembly and the support frame adjacent to the seam are substantially flush with one another along substantially the entire seam.

19. The compact lighting device according to claim 1, wherein the light assembly includes a dome-shaped window and pushing a portion of the dome-shaped window causes the light assembly to tilt on the first axis relative to the mounting element.

20. The compact lighting device according to claim 1, further comprising a wall fastener, a piece of mounting material, or both configured for securing the mounting element to the support surface.

21. A battery-powered lighting device, comprising:

a light assembly including one or more LED;

a support frame for supporting the light assembly, the light assembly and support frame each having cooperable pivot elements that allow the light assembly to pivot relative to the support frame about a transverse axis substantially transverse to the light assembly and support frame; and a mounting element capable of being releasably fastened to the support frame for mounting the light assembly and support frame to a support surface, the mounting element having cooperable rotation elements that allow the support frame and light assembly to rotate relative to the mounting element about a rotation axis substantially transverse to the transverse axis, wherein separating the mounting element from the support frame exposes a battery compartment.

22. The battery-powered lighting device according to claim 21, wherein the support frame and the light assembly are rotatable 360° about the rotation axis.

* * * * *